US011384946B2

(12) United States Patent
Suzuki et al.

(10) Patent No.: US 11,384,946 B2
(45) Date of Patent: Jul. 12, 2022

(54) AIR-CONDITIONING DEVICE

(71) Applicant: DAIKIN INDUSTRIES, LTD., Osaka (JP)

(72) Inventors: Takanori Suzuki, Osaka (JP); Youichi Handa, Osaka (JP); Keita Kitagawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/641,152

(22) PCT Filed: Jul. 11, 2018

(86) PCT No.: PCT/JP2018/026234
§ 371 (c)(1),
(2) Date: Feb. 21, 2020

(87) PCT Pub. No.: WO2019/044198
PCT Pub. Date: Mar. 7, 2019

(65) Prior Publication Data

US 2020/0173670 A1 Jun. 4, 2020

(30) Foreign Application Priority Data

Aug. 28, 2017 (JP) ..... JP2017-163415

(51) Int. Cl.
*F24F 3/14* (2006.01)
*F24F 11/32* (2018.01)
(Continued)

(52) U.S. Cl.
CPC ..... *F24F 3/14* (2013.01); *F24F 11/32* (2018.01); *F24F 11/46* (2018.01); *F24F 11/48* (2018.01);
(Continued)

(58) Field of Classification Search
CPC .... F24F 3/14; F24F 11/46; F24F 11/89; F24F 11/32; F24F 11/63; F24F 11/48;
(Continued)

(56) References Cited

U.S. PATENT DOCUMENTS 7,537,050 B2 * 5/2009 Ikegami ..... B01D 53/265 165/104.21
2006/0278084 A1 12/2006 Kim
(Continued)

FOREIGN PATENT DOCUMENTS

CN 104596051 A 5/2015
CN 103234261 B 9/2015
(Continued)

OTHER PUBLICATIONS

Yageta, Maintenance Support System, Feb. 22, 2007, JP2007046864A, Whole Document (Year: 2007).*
(Continued)

*Primary Examiner* — Larry L Furdge
(74) *Attorney, Agent, or Firm* — Birch, Stewart, Kolasch & Birch, LLP

(57) ABSTRACT

An air-conditioning device that allows sufficient power to be reliably supplied to an imaging device is provided. The air-conditioning device includes a control unit that makes an imaging device capture an image while at least one predetermined component of the air-conditioning device is at rest.

7 Claims, 11 Drawing Sheets

(51) Int. Cl.

| | |
|---|---|
| ***F24F 11/63*** | (2018.01) |
| ***F24F 11/48*** | (2018.01) |
| ***F24F 13/22*** | (2006.01) |
| ***F24F 11/46*** | (2018.01) |
| ***F24F 11/89*** | (2018.01) |
| *F24F 6/00* | (2006.01) |

(52) U.S. Cl.
CPC ..... *F24F 11/63* (2018.01); *F24F 11/89* (2018.01); *F24F 13/222* (2013.01); *F24F 2006/008* (2013.01)

(58) Field of Classification Search
CPC .... F24F 13/222; F24F 2006/008; F24F 11/49; F24F 3/1411; F24F 13/22; F24F 6/00; F24F 11/38
See application file for complete search history.

(56) References Cited

U.S. PATENT DOCUMENTS

| | | | |
|---|---|---|---|
| 2009/0025711 | A1 | 1/2009 | Edwards et al. |
| 2009/0251324 | A1 | 10/2009 | Frederick |
| 2014/0262134 | A1 | 9/2014 | Arensmeiier et al. |
| 2015/0115482 | A1 | 4/2015 | Jang et al. |
| 2016/0056381 | A1 | 2/2016 | Wang |
| 2016/0153824 | A1 | 6/2016 | Myeong et al. |

FOREIGN PATENT DOCUMENTS

| | | | | |
|---|---|---|---|---|
| CN | 106288158 | A | | 1/2017 |
| EP | 3 712 534 | A1 | | 9/2020 |
| JP | S58138938 | A | * | 8/1983 |
| JP | H02-236420 | A | | 9/1990 |
| JP | 8-219528 | A | | 8/1996 |
| JP | 2000-180247 | A | | 6/2000 |
| JP | 2002-101321 | A | | 4/2002 |
| JP | 2005-292066 | A | | 10/2005 |
| JP | 2005292066 | A | * | 10/2005 |
| JP | 2006-64227 | A | | 3/2006 |
| JP | 2007-46864 | A | | 2/2007 |
| JP | 2007046864 | A | * | 2/2007 |
| JP | 2007-255840 | A | | 10/2007 |
| JP | 2010-242994 | A | | 10/2010 |
| JP | 2012-32071 | A | | 2/2012 |
| JP | 2012032071 | A | * | 2/2012 |
| JP | 2013160449 | A | * | 8/2013 |
| JP | 2016196992 | A | * | 11/2016 |
| KP | 2017099516 | A | | 9/2017 |

OTHER PUBLICATIONS

Yumoto et al., Clogging Detector of Air Filter, Aug. 19, 2013, JP2013160449A, Whole Document (Year: 2013).*
Kumamoto, Condition Diagnostic Device, Condition Diagnostic Program and Condition Diagnostic System, Oct. 20, 2005, JP2005292066A, Whole Document (Year: 2005).*
Nakayama, Air Conditioner Having Emergency Drainage Function, Nov. 24, 2016, JP2016196992A, Whole Document (Year: 2016).*
Iwamoto et al., Air Conditioner, Feb. 16, 2012, JP2012032071A), Whole Document (Year: 2012).*
Akamine et al., Air Conditioner, Aug. 18, 1983, JPS58138938A, Whole Document (Year: 1983).*
International Search Report issued in PCT/JP2018/026234 (PCT/ISA/210), dated Oct. 2, 2018.
International Search Report issued in PCT/JP2018/030750 (PCT/ISA/210), dated Nov. 20, 2018.
Extended European Search Report dated Jul. 28, 2020 for Application No. 18850249.6.
Extended European Search Report dated Jul. 28, 2020 for Application No. 18851325.3.
International Preliminary Report on Patentability, dated Mar. 12, 2020, and Written Opinion of the International Searching Authority, for International Application No. PCT/JP2018/026234.
International Preliminary Report on Patentability, dated Mar. 12, 2020, and Written Opinion of the International Searching Authority, for International Application No. PCT/JP2018/030750.
Extended European Search Report dated Nov. 11, 2021 in corresponding EP Application No. 21193232.2.

* cited by examiner

AIR-CONDITIONING DEVICE

TECHNICAL FIELD

The present invention relates to an air-conditioning device.

BACKGROUND ART

An air-conditioning device has been widely known in the art. Patent Document 1 discloses a technique for acquiring image data of a predetermined object to be imaged inside a casing of an air-conditioning device.

The air-conditioning device of Patent Document 1 includes a camera (an imaging device) installed inside a casing of an indoor unit. The camera is positioned such that a target object (such as a filter) can be imaged. Image data of the target object imaged by the camera are output to a central monitor through a LAN. A service provider or any other operator can check the image data transmitted to the central monitor to determine the state of the target object (e.g., clogging and breakage of the filter, and how the filter is installed).

Citation List

Patent Document

Patent Document 1: Japanese Unexamined Patent Publication No. 2007-46864

SUMMARY OF THE INVENTION

Technical Problem

In the air-conditioning device as described above, for example, while a cooling operation is performed, components, such as a fan, are in operation. This increases the power consumed by the air-conditioning device. In such a state, the power supplied to the imaging device may be insufficient.

In view of the foregoing problem, it is therefore an object of the present invention to provide an air-conditioning device that allows sufficient power to be reliably supplied to an imaging device.

Solution to the Problem

A first aspect of the invention is directed to an air-conditioning device. The air-conditioning device includes: a casing (20); an imaging device (70) that acquires image data of at least one predetermined object (45, 60) to be imaged inside the casing (20); and a control unit (19) that makes the imaging device (70) capture an image while at least one predetermined component (40, 40*a*, 40*b*, 43, 45) of the air-conditioning device (10) is at rest.

According to the first aspect of the invention, the imaging device (70) captures an image while the predetermined component (40, 40*a*, 40*b*, 43, 45) of the air-conditioning device (10) is at rest. Thus, at a timing when the imaging device (70) captures an image, the total power consumed by the air-conditioning device is low. Thus, sufficient power can be reliably supplied to the imaging device (70).

A second aspect of the invention is an embodiment of the first aspect of the invention. In the air-conditioning device according to the second aspect, the at least one object (45, 60) to be imaged includes a drain pan (60) that collects condensed water generated inside the casing (20).

According to the second aspect of the invention, the imaging device (70) acquires image data of the drain pan (60). Thus, the service provider or any other operator can determine putrefaction of the condensed water and the state of the formed mold inside the drain pan (60) through the image data.

A third aspect of the invention is an embodiment of the second aspect of the invention. In the air-conditioning device according to the third aspect, the at least one predetermined component (40, 40*a*, 40*b*, 43, 45) includes a fan (40) that transfers air inside the casing (20), and the control unit (19) makes the imaging device (70) capture an image while the fan (40) is at rest.

In the third aspect of the invention, the imaging device (70) captures an image while the fan (40) is at rest. This can reduce the total power consumed by the air-conditioning device (10) when the imaging device (70) captures an image.

The fan (40) in operation causes the surface of the condensed water inside the drain pan (60) to be unstable due to the air flow through the drain pan (60) and the influence of vibrations. In contrast, according to the present invention, since the fan (40) is at rest at the point in time when the imaging device (70) captures an image, the surface of the condensed water inside the drain pan (60) is also stabilized. This can prevent the unstable surface of the condensed water from causing the acquired image data to be blurred.

A fourth aspect of the invention is an embodiment of the second or third aspect of the invention. In the air-conditioning device according to the fourth aspect, the at least one predetermined component (40, 40*a*, 40*b*, 43, 45) includes a heat exchanger (43) that performs a cooling action to cool air inside the casing (20), and the control unit (19) makes the imaging device (70) capture an image while the heat exchanger (43) is at rest, and thus is not performing the cooling action.

According to the fourth aspect of the invention, the imaging device (70) captures an image while the heat exchanger (43) is at rest. This can reduce the total power consumed by the air-conditioning device (10) when the imaging device (70) captures an image.

While the heat exchanger (43) is performing the cooling action, condensed water tends to be generated from the air cooled in the heat exchanger (43). Thus, the water surface in the drain pan (60) tends to rise. In contrast, according to the present invention, the heat exchanger (43) does not perform the cooling action at the point in time when the imaging device (70) captures an image. This prevents the cooling action of the heat exchanger (43) from causing the water surface in the drain pan (60) to rise. This can prevent the rising surface of the condensed water from causing the acquired image data to be blurred.

A fifth aspect of the invention is an embodiment of the fourth aspect of the invention. In the air-conditioning device according to the fifth aspect, the control unit (19) makes the imaging device (70) capture an image after a stop of the cooling action of the heat exchanger (43).

According to the fifth aspect of the invention, the imaging device (70) captures an image after the stop of the cooling action of the heat exchanger (43). Condensed water is generated from air cooled in the heat exchanger (43) until immediately before the stop of the cooling action of the heat exchanger (43). Thus, after the stop of the cooling action of the heat exchanger (43), the condensed water can be expected to be accumulated inside the drain pan (60) to some extent. Thus, capturing an image at this point in time allows the state of the condensed water inside the drain pan (60) to be easily determined.

A sixth aspect of the invention is an embodiment of the fourth or fifth aspect of the invention. In the air-conditioning device according to the sixth aspect, the control unit (19) makes the imaging device (70) capture an image before a start of the cooling action of the heat exchanger (43).

According to the sixth aspect of the invention, the imaging device (70) captures an image before the start of the cooling action of the heat exchanger (43). The heat exchanger (43) is at rest during a certain period between the start of the cooling action of the heat exchanger (43) and the end of the previous cooling action. During this period, putrefaction of the condensed water accumulated in the drain pan (60) and the formation of mold gradually progress. Thus, before the start of the cooling action, such putrefaction of the condensed water and the degree of mold formed tend to be apparent. According to the present invention, to image the drain pan (60) in synchronization with this point in time, the putrefaction of the condensed water and the formation of mold are apparent from the image data. This allows the degree of dirt on the drain pan (60) to be more clearly determined.

A seventh aspect of the invention is an embodiment of any one of the second to sixth aspects. In the air-conditioning device according to the seventh aspect, the at least one predetermined component (40, 40*a*, 40*b*, 43, 45) includes a drain pump (66) that drains the condensed water inside the drain pan (60), and the control unit (19) makes the imaging device (70) capture an image while the drain pump (66) is at rest.

According to the seventh aspect of the invention, the imaging device (70) captures an image while the drain pump (66) is at rest. This can reduce the total power consumed by the air-conditioning device (10) when the imaging device (70) captures an image.

The drain pump (66) in operation causes the surface of the condensed water inside the drain pan (60) to be unstable due to the suction of the condensed water into the drain pump (66) and vibrations of the drain pump (66). In contrast, according to the present invention, since the drain pump (66) is at rest at the point in time when the imaging device (70) captures an image, the surface of the condensed water inside the drain pan (60) is also stabilized. This can prevent the unstable surface of the condensed water from causing the acquired image data to be blurred.

An eighth aspect of the invention is an embodiment of the seventh aspect of the invention. In the air-conditioning device according to the eighth aspect, the control unit (19) makes the imaging device (70) capture an image after a stop of an operation of the drain pump (66).

According to the eighth aspect of the invention, the imaging device (70) captures an image after the stop of the operation of the drain pump (66). The condensed water inside the drain pan (60) is drained until immediately before the stop of the operation of the drain pump (66). Thus, after the stop of the operation of the drain pump (66), the condensed water should not be accumulated so much in the drain pan (60). Nevertheless, if a relatively large amount of condensed water is present inside the drain pan (60), the drain pump (66) may be broken, or a drain pipe may be clogged. Thus, imaging the inside of the drain pan (60) at this point in time allows the foregoing problems and similar problems associated with a structure for draining the condensed water to be detected.

A ninth aspect of the invention is an embodiment of the seventh or eighth aspect of the invention. In the air-conditioning device according to the ninth aspect, the control unit (19) makes the imaging device (70) capture an image before a start of an operation of the drain pump (66).

According to the ninth aspect of the invention, the imaging device (70) captures an image before the stop of the operation of the drain pump (66). The condensed water is accumulated inside the drain pan (60) until before the start of the operation of the drain pump (66). Thus, capturing an image at this point in time allows the state of the condensed water inside the drain pan (60) to be easily determined.

A tenth aspect of the invention is an embodiment of any one of the first to ninth aspects of the invention. In the air-conditioning device according to the tenth aspect, the at least one object (45, 60) to be imaged includes a humidifying element (45) that humidifies air inside the casing (20).

According to the tenth aspect of the invention, the imaging device (70) acquires image data of the humidifying element (45). Thus, the service provider or any other operator can determine the states of scale, mold, and other depositions formed on the humidifying element (45) through the image data.

An eleventh aspect of the invention is an embodiment of the tenth aspect of the invention. In the air-conditioning device according to the eleventh aspect, the control unit (19) makes the imaging device (70) capture an image before a start of an operation of the humidifying element (45) serving as the predetermined component.

According to the eleventh aspect of the invention, the imaging device (70) captures an image while the humidifying element (45) is at rest. This can reduce the total power consumed by the air-conditioning device (10) when the imaging device (70) captures an image.

According to the prevent invention, the imaging device (70) captures an image before the start of the operation of the humidifying element (45). The humidifying element (45) is at rest during a certain period between the start of the operation of the humidifying element (45) and the end of the previous operation. During this period, the formation of scale and mold on the hygroscopic materials of the humidifying element (45) gradually progresses. Thus, before the start of the operation of the humidifying element (45), the degree of such scale and mold formed tend to be apparent. According to the present invention, since the humidifying element (45) is imaged in synchronization with this point in time, the formation of scale and mold is apparent from the image data. This allows the degree of dirt on the humidifying element (45) to be more clearly determined.

Advantages of the Invention

According to the present invention, an imaging device (70) captures an image while a predetermined component (40, 40*a*, 40*b*, 43, 45) is at rest. This allows sufficient power to be reliably supplied to the imaging device (70). As a result, the reliability of the imaging device (70) can be improved. Further, the capacity of a power source of an air-conditioning device (10) can be reduced.

DESCRIPTION OF EMBODIMENTS

Embodiments of the present invention will be described in detail below with reference to the drawings. The embodiments below are merely exemplary ones in nature, and are not intended to limit the scope, applications, or use of the present invention.

First Embodiment

An air-conditioning device (10) according to a first embodiment of the present invention adjusts at least the temperature of air. Specifically, the air-conditioning device (10) adjusts the temperature of room air (RA), and supplies the temperature-adjusted air as supply air (SA) into the room. The air-conditioning device (10) includes an indoor unit (11) installed in a space in the ceiling cavity. The indoor unit (11) is connected to an outdoor unit (not shown) through refrigerant pipes. Thus, the air-conditioning device (10) forms a refrigerant circuit. The refrigerant circuit is filled with a refrigerant that circulates to perform a vapor compression refrigeration cycle. The outdoor unit is provided with a compressor and an outdoor heat exchanger that are connected to the refrigerant circuit, and an outdoor fan that corresponds to the outdoor heat exchanger.

<Indoor Unit>

Figure 1:
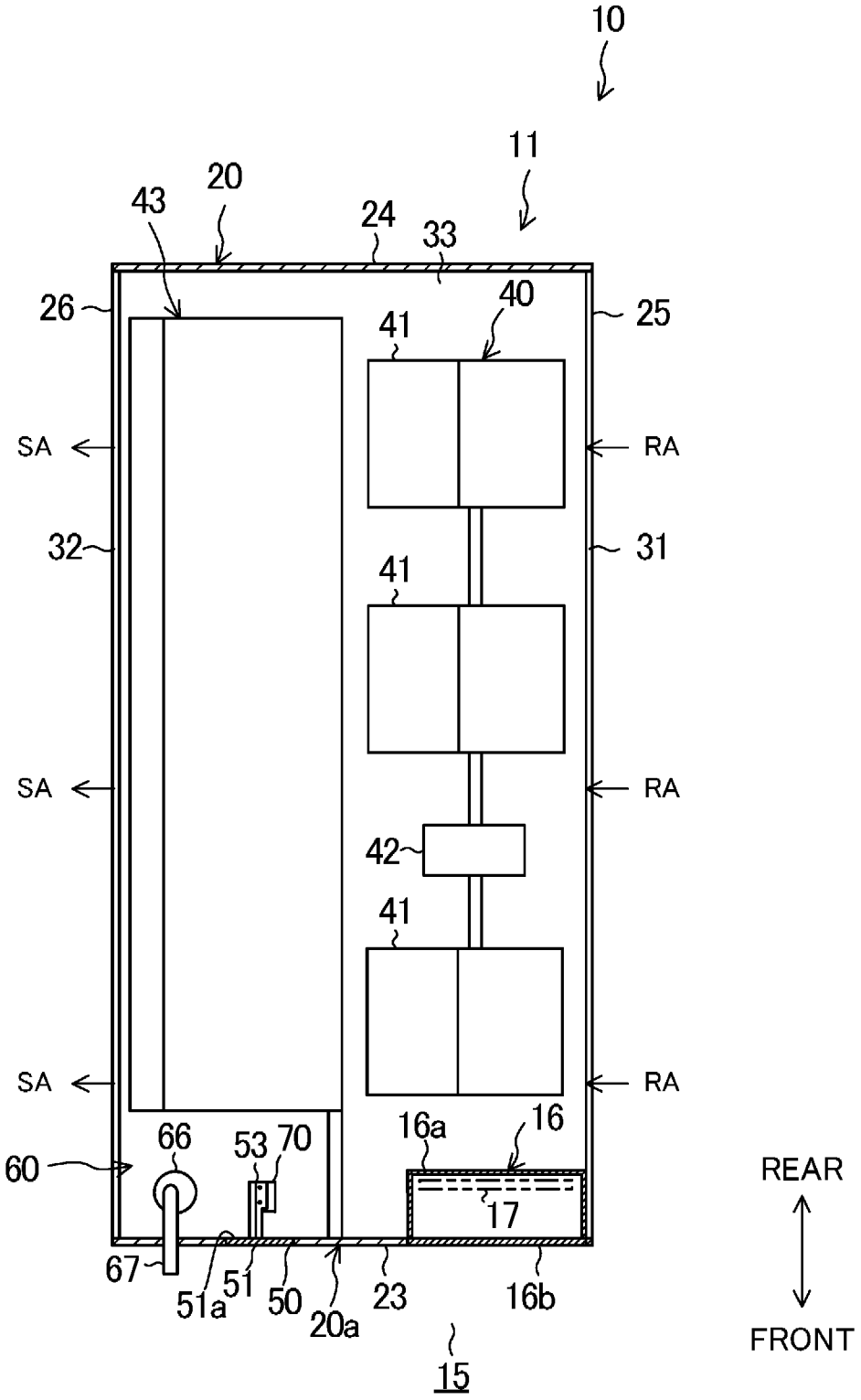
FIG. 1 is a plan view illustrating an internal structure of an air-conditioning device according to a first embodiment.
Figure 2:
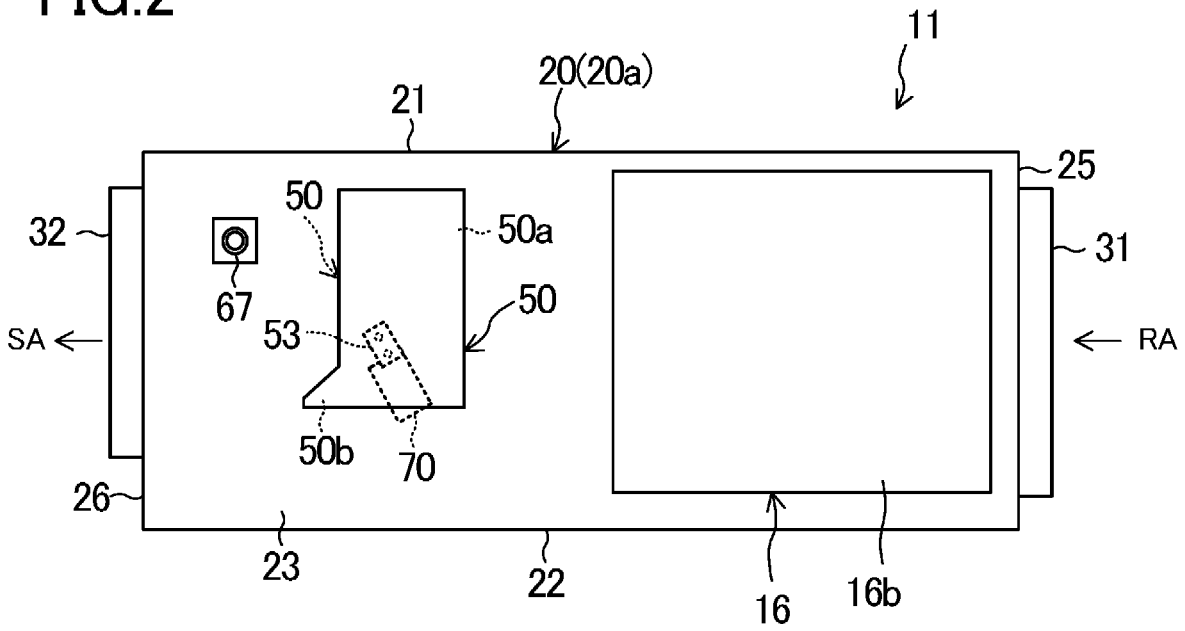
FIG. 2 is a front view illustrating the air-conditioning device according to the first embodiment.
Figure 3:
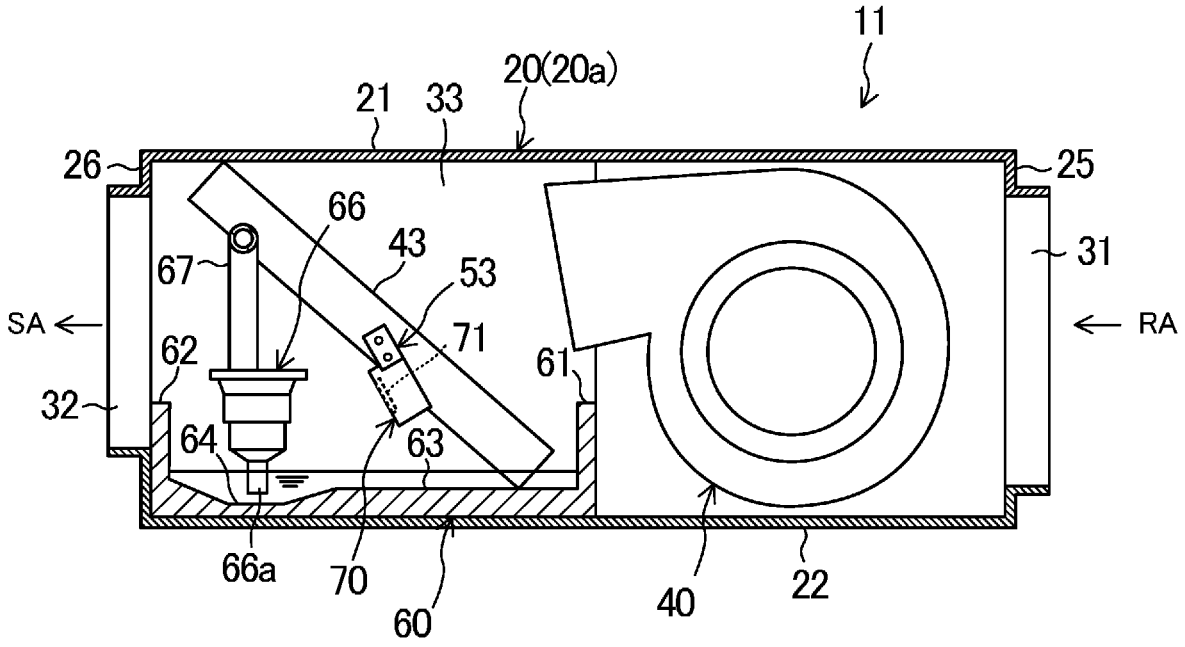
FIG. 3 is a longitudinal sectional view illustrating the internal structure of the air-conditioning device according to the first embodiment.

As illustrated in FIGS. 1 to 3, the indoor unit (11) includes a casing (20) installed in the ceiling cavity, and a fan (40) and an indoor heat exchanger (43) both housed in the casing (20). The casing (20) includes therein a drain pan (60) collecting condensed water generated from air in the casing (20), and a drain pump (66) for discharging water accumulated in the drain pan (60).

<Casing>

The casing (20) has the shape of a rectangular parallelepiped hollow box. The casing (20) includes a top plate (21), a bottom plate (22), and four side plates (23, 24, 25, 26). The four side plates include a front panel (23), a rear panel (24), a first side panel (25), and a second side panel (26). The front and rear panels (23) and (24) face each other. The first and second side panels (25) and (26) face each other.

The front panel (23) faces a maintenance space (15). The front panel (23) is provided with an electric component box (16), an inspection hole (50), and an inspection cover (51) (which will be described below in detail). The first side panel (25) has a suction port (31). A suction duct (not shown) is connected to the suction port (31). The inlet end of the suction duct communicates with an indoor space. The second side panel (26) has a blow-out port (32). An exhaust duct (not shown) is connected to the blow-out port (32). The blow-out port end of the exhaust duct is connected to the indoor space. The casing (20) has therein an air flow path (33) between the suction port (31) and the blow-out port (32).

<Fan>

The fan (40) is disposed in a portion of the air flow path (33) near the first side panel (25). The fan (40) transfers air in the air flow path (33). In this embodiment, three sirocco fans (41) are driven by one motor (42) (see FIG. 1).

<Indoor Heat Exchanger>

The indoor heat exchanger (43) is disposed in a portion of the air flow path (33) near the second side panel (26). The indoor heat exchanger (43) is configured as, for example, a fin-and-tube heat exchanger. The indoor heat exchanger (43) of this embodiment is arranged obliquely. The indoor heat exchanger (43) serving as an evaporator constitutes a cooling portion that cools air.

<Drain Pan>

As schematically illustrated in FIG. 3, the drain pan (60) is disposed under the indoor heat exchanger (43) to extend along the bottom plate (22). The drain pan (60) includes a first side wall (61), a second side wall (62), and a bottom portion (63). The first side wall (61) is located upstream of the indoor heat exchanger (43). The second side wall (62) is located downstream of the indoor heat exchanger (43). The bottom portion (63) extends from the first side wall (61) to the second side wall (62). The bottom portion (63) has a concave portion (64) having a substantially trapezoidal cross section near the center of the bottom portion (63). In the drain pan (60), the bottom surface of the concave portion (64) is lowest in height. In other words, the concave portion (64) includes the deepest point of the drain pan (60).

<Drain Pump>

A drain pump (66) is disposed inside the drain pan (60). Specifically, a suction portion (66*a*) of the drain pump (66) is disposed inside the concave portion (64) of the drain pan (60). A blow-out port of the drain pump (66) is connected to the inlet end of a drain pipe (67). The drain pipe (67) passes through the front panel (23) of the casing (20) in a horizontal direction. When the drain pump (66) starts operating, condensed water accumulated in the drain pan (60) is pumped up. The water pumped up is discharged to the outside of the casing (20) through the drain pipe (67).

<Electric Component Box>

As illustrated in FIG. 1, the electric component box (16) is disposed on a portion of the front panel (23) near the fan (40). The electric component box (16) houses therein a printed board (17) on which a power supply circuit, a control circuit, and any other circuit are mounted, wires respectively connected to the circuits, a high-voltage power source, a low-voltage power source, and other components. The electric component box (16) includes a box body (16*a*) having a front surface with an opening, and an electric component cover (16*b*) opening and closing the opening surface of the box body (16*a*). The electric component cover (16*b*) forms a portion of the front panel (23). When the electric component cover (16*b*) is detached, the inside of the electric component box (16) can be exposed to the maintenance space (15).

<Inspection Hole and Inspection Cover>

Figure 4:
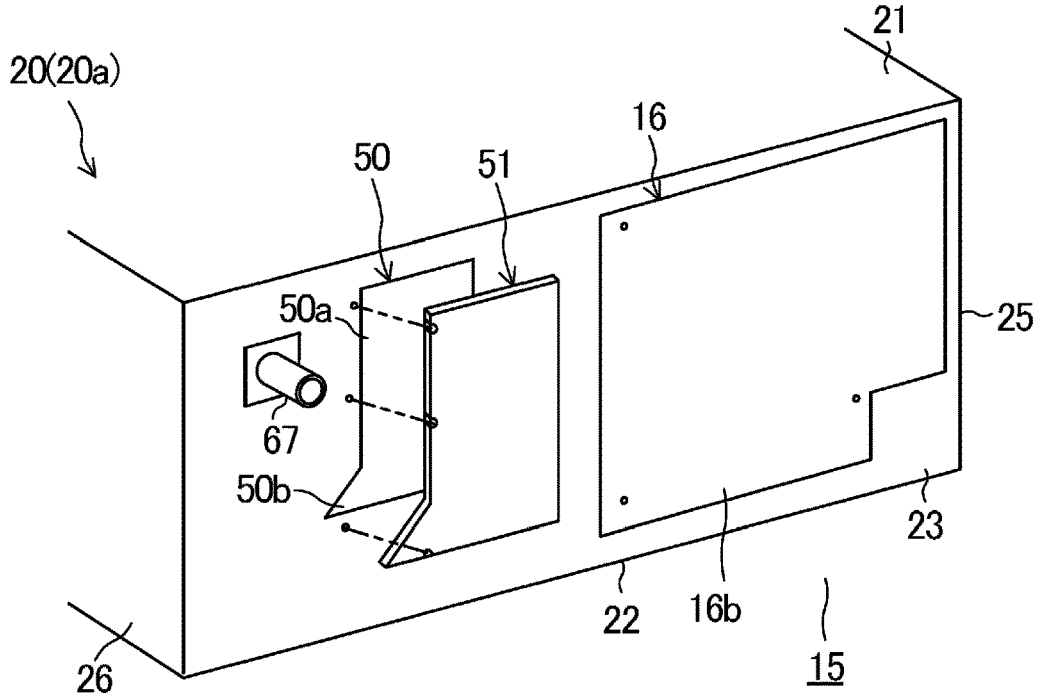
FIG. 4 is a perspective view illustrating a schematic configuration of a portion of the air-conditioning device near a front panel according to the first embodiment.

As illustrated in FIG. 1, the inspection hole (50) is disposed in a portion of the front panel (23) near the indoor heat exchanger (43). As illustrated in FIGS. 2 and 4, the inspection hole (50) includes a rectangular portion (50*a*), and a triangular portion (50*b*) that is continuous with one lower corner of the rectangular portion. The triangular portion (50*b*) protrudes from the rectangular portion (50*a*) toward the second side panel (26). The inspection hole (50) is formed at a position corresponding to the drain pan (60). When the inspection cover (51) is detached from the inspection hole (50), the inside of the drain pan (60) can be inspected from the maintenance space (15).

The inspection cover (51) has a shape substantially similar to that of the inspection hole (50), and is slightly larger than the inspection hole (50). The inspection cover (51) has an edge portion having a plurality of (three in this example) fastening holes (52) through which the inspection cover (51) is attached to the casing body (20*a*). The inspection cover (51) is fixed to the casing body (20*a*) through a plurality of fastening members (for example, bolts) inserted into, and run through, the fastening holes (52). Such a configuration allows the inspection cover (51) to be detachably attached to the casing body (20*a*) to open and close the inspection hole (50).

<Stay and Camera>

Figure 5:
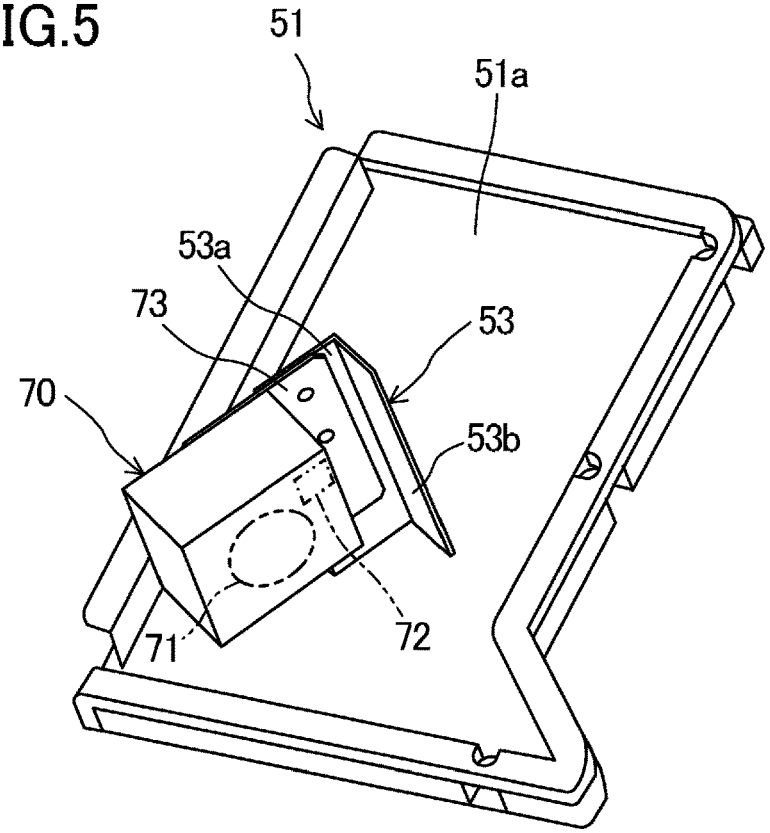
FIG. 5 is a perspective view illustrating an internal structure of an inspection cover according to the first embodiment.

As illustrated in FIG. 5, an inner wall (51*a*) of the inspection cover (51) is provided with a stay (53) for supporting a camera (70) on the inspection cover (51). The stay (53) is fixed to the inner wall (51*a*) of the inspection cover (51), and constitutes a support member to which the camera (70) is attached.

The stay (53) is fixed to a substantially central portion of the inner wall (51*a*) of the inspection cover (51), and extends in the horizontal direction. A base portion of the stay (53) may be welded to, for example, the inspection cover (51), or may be fastened to the inspection cover (51) via a plurality of bolts (fastening members). If the stay (53) is welded to the inspection cover (51), the inspection cover (51) does not have to have any fastening hole. This makes it easy for the inspection cover (51) to reliably have high sealing performance and high thermal insulation properties. On the other hand, if the stay (53) is fastened to the inspection cover (51) via the fastening members, the relative positions of the stay (53) and the inspection cover (51) can be reliably determined.

A cross section of the stay (53) perpendicular to the length of the stay (53) has a substantially L-shape. More particularly, the stay (53) includes a first plate portion (53*a*), and a second plate portion (53*b*) substantially perpendicular to the first plate portion (53*a*).

In a state where the inspection cover (51) is attached to the casing body (20*a*) (hereinafter simply referred to as the "attached state of the inspection cover (51)"), the stay (53) is disposed such that the junction between the first and second plate portions (53*a*) and (53*b*) faces upward. In the attached state of the inspection cover (51), a lower surface of the first plate portion (53*a*) faces the drain pan (60) (strictly speaking, the concave portion (64) of the drain pan (60)).

The camera (70) is detachably attached to the stay (53). The camera (70) constitutes an imaging device for imaging the target drain pan (60) to acquire image data. The camera (70) includes a lens (71) and a flash (72). The lens is configured as a super-wide-angle lens. A support plate (73) is fixed to the back surface of the camera (70). The support plate (73) is fixed to the first plate portion (53*a*) of the stay (53) via a bolt (not shown). As a result, the camera (70) is supported by the stay (53) and thus by the inspection cover (51).

In the attached state of the inspection cover (51), the lens (71) of the camera (70) faces the drain pan (60) (strictly speaking, the concave portion (64) of the drain pan (60)). That is to say, the camera (70) is positioned such that the concave portion (64) of the drain pan (60) can be imaged in the attached state of the inspection cover (51) (see FIG. 3).

<Imaging System>

An imaging system (S) according to this embodiment will be described with reference to FIG. 6. The imaging system (S) according to this embodiment includes the camera (70) described above, a power source (18), an air-conditioning control unit (19), and a communication terminal (80).

The camera (70) described above is provided in the casing (20) of the indoor unit (11). The camera (70) includes an imaging control unit (74), a storage (75), an ID provider (76), a wireless communication section (77), and an input section (79).

The imaging control unit (74) constitutes a control unit that controls an imaging operation of the camera (70). The imaging control unit (74) makes the camera (70) capture an image in conjunction with a signal (X) input from the air-conditioning control unit (19) to the input section (79). This will be described in detail below. Thus, the camera (70) acquires image data of the object to be imaged (in this embodiment, the drain pan (60)). The imaging control unit (74) includes a microcomputer and a memory device (specifically, a semiconductor memory) that stores software for operating the microcomputer.

The storage (75) stores the acquired image data. The storage (75) includes various memory devices (semiconductor memories).

The ID provider (76) associates ID information corresponding to the image data with the corresponding image data. Examples of the ID information include the date and time of imaging, and the model and location of the air-conditioning device corresponding to the imaged drain pan (60). Thus, the storage (75) stores the image data including these pieces of the ID information.

The wireless communication section (77) is wirelessly connected to the communication terminal (80). The wireless communication section (77) constitutes a wireless transmitter. The wireless communication section (77) is configured as, for example, a wireless router. The wireless communication section (77) is connected to the communication terminal (80) around the air-conditioning device (10) via a wireless LAN. Thus, data can be exchanged between the camera (70) and the communication terminal (80). Specifically, the wireless communication section (77) wirelessly transmits the image data acquired by the camera (70) to the communication terminal (80). The wireless communication section (77) receives a command to capture an image from the communication terminal (80) (e.g., a service provider) as appropriate.

The power source (18) is provided, for example, inside the electric component box (16) of the air-conditioning device (10). A power source line (85) of the camera (70) is led to the outside of the casing (20) through, for example, the inspection hole (50), and drawn into the electric component box (16) from the outside. Such wiring allows the camera (70) in the casing (20) and the power source (18) in the electric component box (16) to be connected together through the power source line (85). Thus, electric power is supplied to the camera (70) from the power source (18). The power source (18) serves also as a power source for other components of the air-conditioning device (10).

The air-conditioning control unit (19) controls the fan (40), the drain pump (66), various components of the refrigerant circuit, and other components as appropriate in the cooling and heating operations described above. The air-conditioning control unit (19) outputs the signal (X) from the electric components in conjunction with the control of these predetermined components. The camera (70) acquires image data of the drain pan (60) in conjunction with the signal (X).

The communication terminal (80) is configured as a smartphone, a tablet terminal, a mobile phone, a personal computer, or any other suitable device, which is connectable to a wireless LAN or any other suitable network. The communication terminal (80) includes a microcomputer, software for operating the microcomputer, a memory device serving as a storage, a receiver for receiving image data, and a sender for outputting a predetermined instruction.

The communication terminal (80) includes an operating unit (81) and a display (82). The service provider or any other operator operates predetermined application software using the operating unit (81), such as a keyboard or a touch panel. The image data acquired by the camera (70) can be downloaded through the application software displayed on the display (82).

Operation

A basic operation of the air-conditioning device (10) according to the first embodiment will be described with reference to FIGS. 1 and 3. The air-conditioning device (10)*i* be capable of performing a cooling operation and a heating operation.

In the cooling operation, a refrigerant compressed by the compressor of the outdoor unit dissipates heat (condenses) in the outdoor heat exchanger, and is decompressed at an expansion valve. The decompressed refrigerant evaporates in the indoor heat exchanger (43) of the indoor unit (11), and is again compressed by the compressor.

When the fan (40) is operated, room air (RA) in the indoor space is sucked into the air flow path (33) through the suction port (31). The air in the air flow path (33) passes through the indoor heat exchanger (43). In the indoor heat exchanger (43), the refrigerant absorbs heat from the air, thereby cooling the air. The cooled air passes through the blow-out port (32), and is then supplied as supply air (SA) to the indoor space.

Here, if the air is cooled to a temperature equal to or lower than the dew point in the indoor heat exchanger (43), water in the air condenses. The condensed water thus generated is collected in the drain pan (60) as appropriate. The condensed water collected in the drain pan (60) is discharged to the outside of the casing (20) by the drain pump (66).

On the other hand, in the heating operation, a refrigerant compressed by the compressor of the outdoor unit dissipates heat (condenses) in the indoor heat exchanger (43) of the indoor unit (11), and is decompressed at an expansion valve. The decompressed refrigerant evaporates in the outdoor heat exchanger of the outdoor unit, and is again compressed by the compressor. Thus, in the indoor heat exchanger (43), the refrigerant dissipates heat to the air, thereby heating the air.

<Operation of Imaging System>

In the attached state of the inspection cover (51), the lens (71) of the camera (70) is directed to the inside of the drain pan (60). In this state, when a command for capturing an image is input to the camera (70), the camera (70) captures an image. During imaging, the flash (72) operates so that the inside of the drain pan (60) is illuminated. Thus, image data of the inside of the drain pan (60) are acquired.

The image data stored in the camera (70) in this manner are output to the communication terminal (80) together with the ID information. Thus, the service provider or any other operator can check the image data through the display (82), and can determine the state of the drain pan (60) as appropriate. Specifically, the service provider or any other operator can check the image data to determine the degrees of putrefaction, mold contamination, dirt contamination, and other types of contamination in the condensed water in the drain pan (60), the water level in the drain pan (60), whether or not the drain pipe (67) has been clogged, and whether or not the drain pump (66) has been broken.

<Timing of Imaging>

The timing when the camera (70) images the drain pan (60) will be described in detail with reference to FIGS. 6 and 7. The camera (70) captures an image in conjunction with the cooling operation described above.

Specifically, the camera (70) of this embodiment captures an image before the start of an operation of the fan (40) and before the start of a cooling action of the indoor heat exchanger (43).

The cooling action of the indoor heat exchanger (43) as used herein means an action of cooling air through a refrigerant flowing through the indoor heat exchanger (43) serving as an evaporator. Thus, the state where the indoor heat exchanger (43) is at rest means a state where the refrigerant does not substantially flow through the indoor heat exchanger (43), and air is not cooled. In the air-conditioning device (10), for example, the compressor stops, or the flow of the refrigerant through the indoor heat exchanger (43) is restricted, thereby causing the indoor heat exchanger (43) to be at rest.

Figure 7:
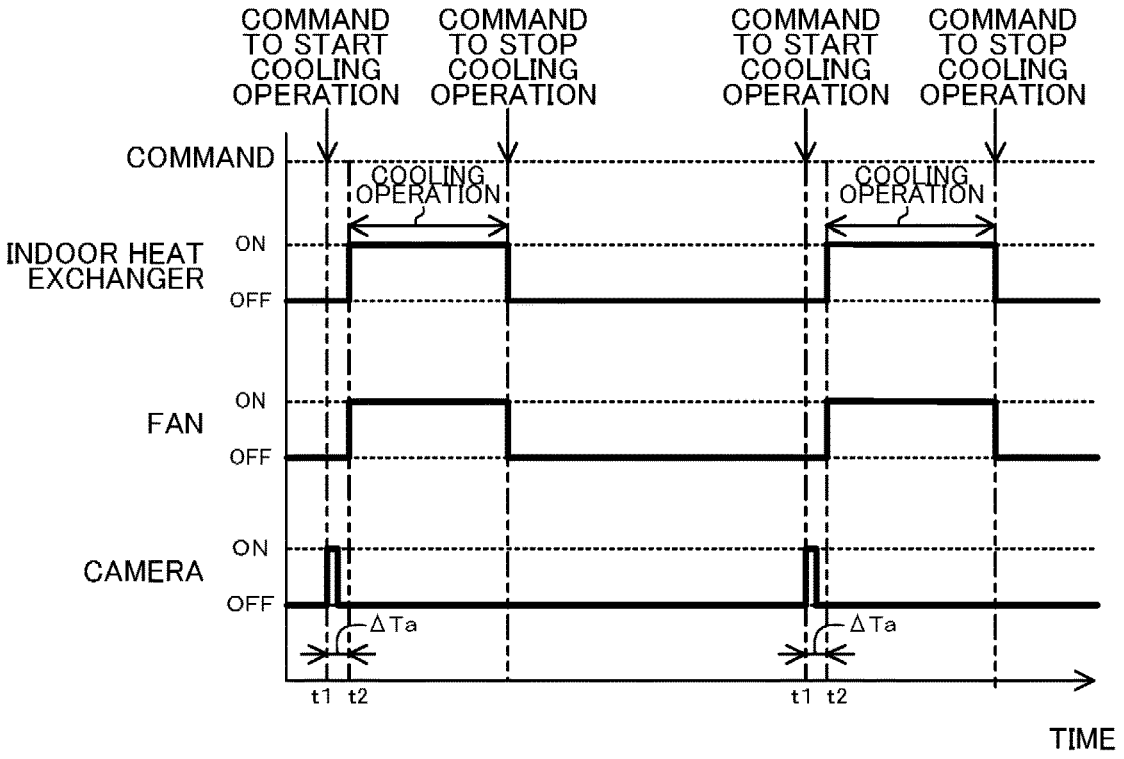
FIG. 7 is a timing chart showing timings of actions of components according to the first embodiment.

As shown in FIG. 7, if an instruction to start the cooling operation is input to the air-conditioning control unit (19) at the point in time t1, the air-conditioning control unit (19) performs control for operating the fan (40) and control for starting the cooling action of the indoor heat exchanger (43) at the point in time t2 that is ΔTa later than the point in time t1. As a result, the cooling operation is started from the point in time t2.

Meanwhile, the air-conditioning control unit (19) outputs the signal (X) for triggering the camera (70) to capture an image to the camera (70) at the same time as the point in time t1 when the instruction to start the cooling operation is input. If this signal (X) is input to the input section (79) of the camera (70), the imaging control unit (74) makes the camera (70) capture an image. Thus, the camera (70) acquires image data of the drain pan (60) at substantially the same timing as the instruction to start the cooling operation. As can be seen from the foregoing description, in this embodiment, the camera (70) captures an image immediately before the start of the operation of the fan (40) and immediately before the start of the cooling action of the indoor heat exchanger (43). In other words, the camera (70) captures an image immediately before the start of the cooling operation.

Advantages of First Embodiment

At the point in time t1 of imaging according to the first embodiment, the fan (40) and the indoor heat exchanger (43) are at rest. Thus, at the point in time t1, the total power consumed by the air-conditioning device (10) is low. This allows sufficient power to be reliably supplied to the camera (70) from the power source (18).

The fan (40) in operation causes the surface of the condensed water inside the drain pan (60) to be unstable due to the air flow through the drain pan (60) and the influence of vibrations. In contrast, in this embodiment, since the fan (40) is at rest at the point in time t1, the surface of the condensed water inside the drain pan (60) is also stabilized. This can prevent the unstable surface of the condensed water from causing the image data of the drain pan (60) to be blurred.

While the indoor heat exchanger (43) is performing the cooling action, condensed water is easily generated from the air cooled in the indoor heat exchanger (43). Thus, the water surface in the drain pan (60) tends to rise. In contrast, in this embodiment, at the point in time t1, the indoor heat exchanger (43) is at rest. This prevents the cooling action of the indoor heat exchanger (43) from causing the water surface in the drain pan (60) to rise. This can prevent the rising surface of the condensed water from causing the image data of the drain pan (60) to be blurred.

During the period between the previous cooling operation and the next cooling operation (i.e., the period during which the air-conditioning device (10) is at rest), putrefaction of the condensed water accumulated in the drain pan (60) and the formation of mold gradually progress. Thus, immediately before the start of the cooling operation, such putrefaction of the condensed water and the degree of mold formed tend to be apparent. In this embodiment, the drain pan (60) is imaged at the point in time t1 immediately before the start of the next cooling operation. Thus, the putrefaction of the condensed water and the formation of mold are apparent from the image data. This allows the degree of dirt on the drain pan (60) to be more clearly determined.

<Other Control Examples of Timing of Imaging Operation>

In the foregoing embodiment, the drain pan (60) may be imaged at the timing described below. Note that the timings in the foregoing embodiment and other embodiments exemplified below may be combined together.

First Control Example

In a first control example, the camera (70) captures an image after the stop of an operation of the fan (40) and after the stop of a cooling action of the indoor heat exchanger (43).

Figure 8:
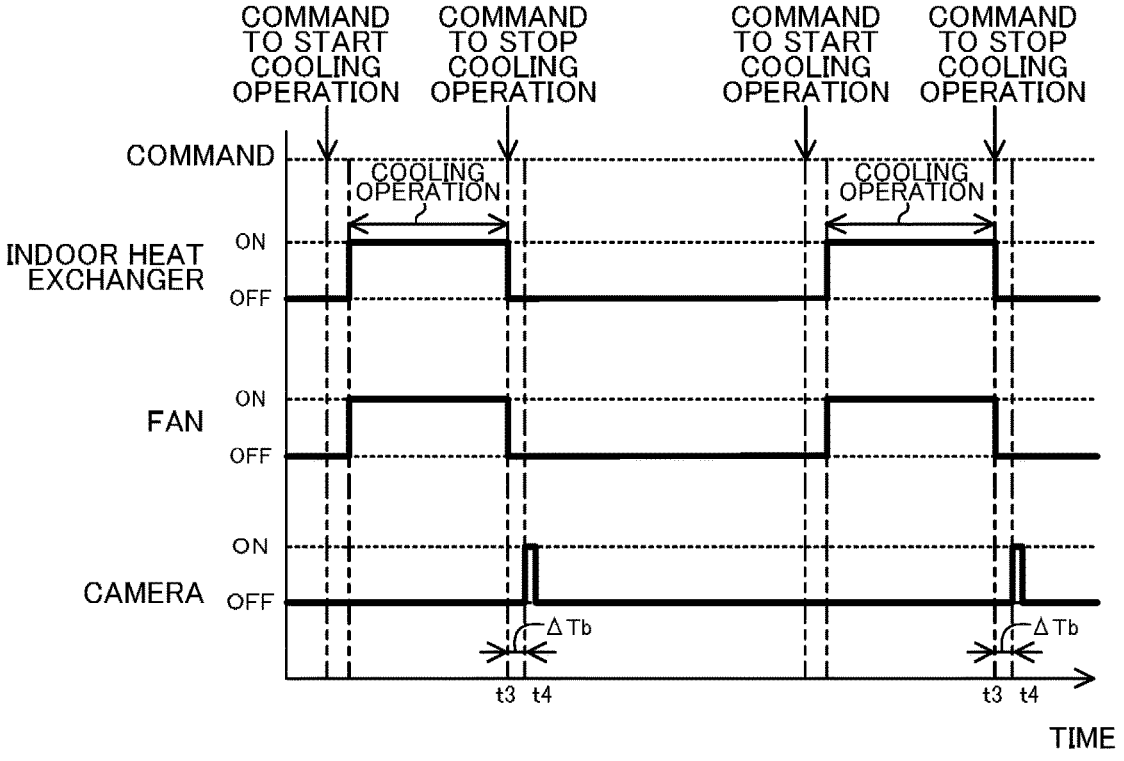
FIG. 8 is a timing chart showing timings of actions of components according to a first control example.

As shown in FIG. 8, if an instruction to stop a cooling operation is input to the air-conditioning control unit (19) at the point in time t3, the air-conditioning control unit (19) performs control for stopping the fan (40) and control for stopping the cooling action of the indoor heat exchanger (43). As a result, the cooling operation is stopped from the point in time t3.

Meanwhile, the air-conditioning control unit (19) outputs the signal (X) for triggering the camera (70) to capture an image to the camera (70) at the point in time t4 that is ΔTb later than the point in time t3. If this signal (X) is input to the input section (79) of the camera (70), the imaging control unit (74) makes the camera (70) capture an image. Thus, the camera (70) acquires image data of the drain pan (60) at a timing slightly later than the end of the cooling operation. As can be seen from the foregoing description, in this embodiment, the camera (70) captures an image immediately after the end of the operation of the fan (40) and immediately after the end of the cooling action of the indoor heat exchanger (43). In other words, the camera (70) captures an image immediately after the stop of the cooling operation.

At the point in time t4 of imaging according to another first control example, the fan (40) and the indoor heat exchanger (43) are at rest. Thus, just like the foregoing embodiment, the total power consumed by the air-conditioning device (10) is low. This allows sufficient power to be reliably supplied to the camera (70) from the power source (18). Further, since the fan (40) and the indoor heat exchanger (43) are at rest, the water surface in the drain pan (60) is stabilized during imaging.

The indoor heat exchanger (43) performs a cooling action, and condensed water is thus highly likely to be generated from air, until immediately before the point in time t4. Thus, at the point in time t4, the condensed water is basically accumulated inside the drain pan (60). Thus, acquiring the image data of the drain pan (60) at the point in time t4 allows the state of the condensed water inside the drain pan (60) to be checked.

Second Control Example

In a second control example, the camera (70) captures an image after the stop of an operation of the drain pump (66). Here, the drain pump (66) is operated at the same time as the start of the cooling operation, for example, and is stopped immediately after the stop of the cooling operation. Alternatively, the drain pump (66) may be intermittently operated using a timer or any other tool, or may be operated if the water level in the drain pan (60) exceeds a predetermined level.

Figure 9:
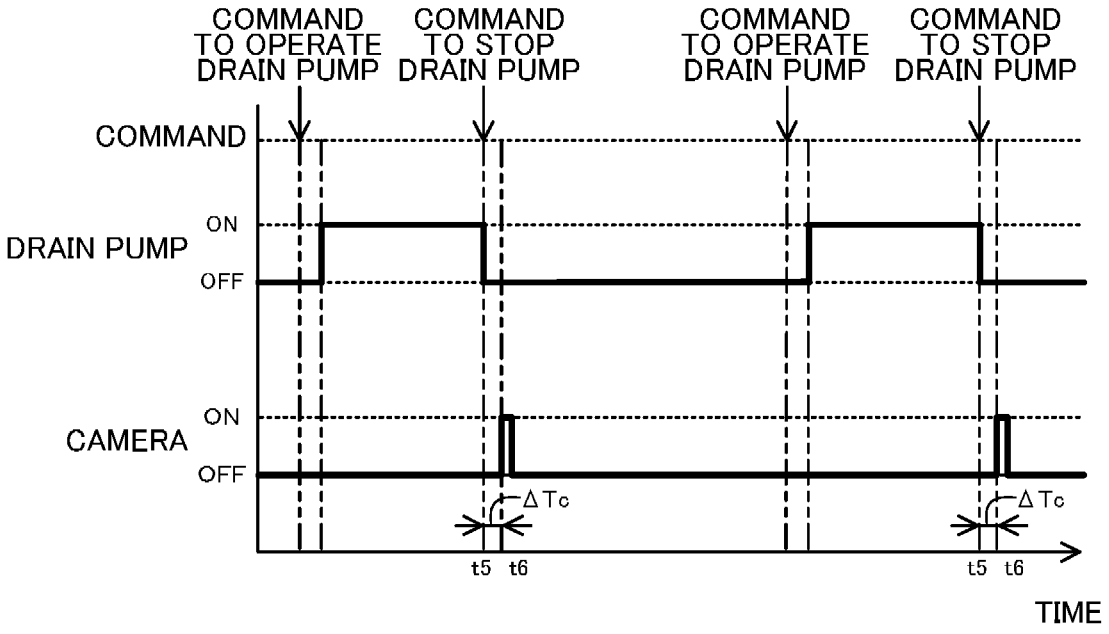
FIG. 9 is a timing chart showing timings of actions of components according to a second control example.

As shown in FIG. 9, for example, if an instruction to stop the drain pump (66) is issued at the point in time t5, the air-conditioning control unit (19) performs control for stopping the drain pump (66) at the point in time t5. In this case, the air-conditioning control unit (19) outputs the signal (X) to the input section (79) of the camera (70) at the point in time t6 that is ΔTc later than the point in time t5. Thus, at a point in time t6 immediately after the stop of the drain pump (66), the camera (70) captures an image.

At the point in time t6 of imaging according to another second control example, the drain pump (66) is at rest. Thus, just like the foregoing embodiment, the total power consumed by the air-conditioning device (10) is low. This allows sufficient power to be reliably supplied to the camera (70) from the power source (18).

The drain pump (66) in operation causes the surface of the condensed water inside the drain pan (60) to be unstable due to the suction of the condensed water into the drain pump (66) and vibrations of the drain pump (66). In contrast, since the drain pump (66) is at rest at the point in time t6, the surface of the condensed water inside the drain pan (60) is also stabilized. This can prevent the unstable surface of the condensed water from causing the acquired image data to be blurred.

The condensed water inside the drain pan (60) is drained until immediately before the stop of the operation of the drain pump (66). Thus, immediately after the stop of the operation of the drain pump (66), the condensed water should not be accumulated so much in the drain pan (60). Nevertheless, if a relatively large amount of condensed water is present inside the drain pan (60), the drain pump (66) may be broken, or a drain pipe may be clogged. Thus, imaging the inside of the drain pan (60) at the point in time t6 allows the foregoing problems and similar problems associated with a structure for draining the condensed water to be detected.

Third Control Example

Figure 10:
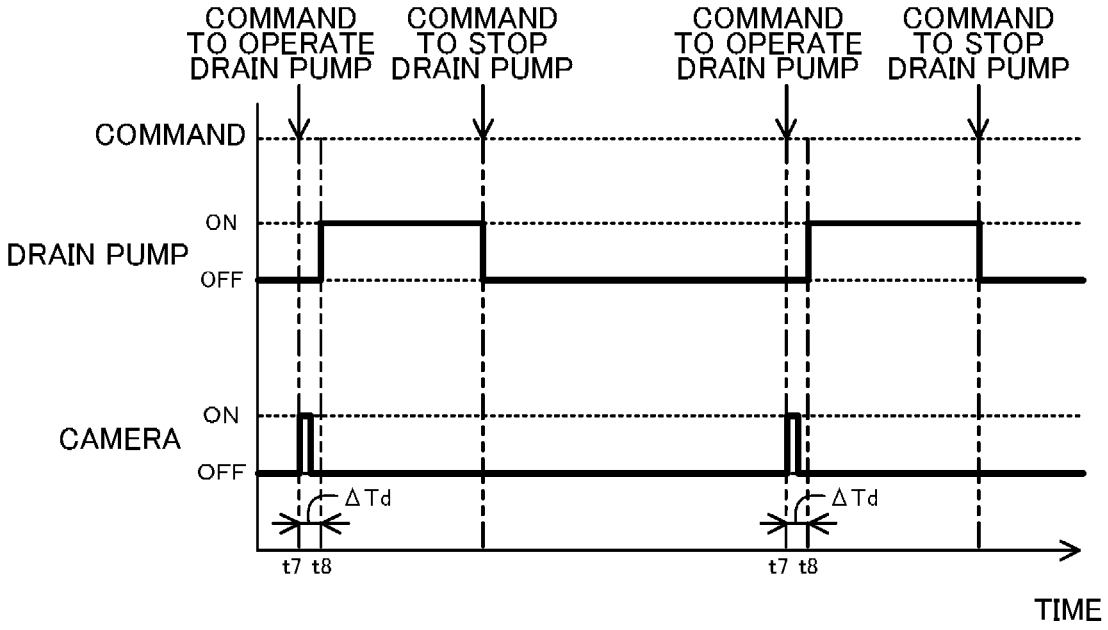
FIG. 10 is a timing chart showing timings of actions of components according to a third control example.

In a third control example, the camera (70) captures an image before the start of an operation of the drain pump (66). As shown in FIG. 10, for example, if an instruction to operate the drain pump (66) is issued at the point in time t7, the air-conditioning control unit (19) performs control for operating the drain pump (66) at the point in time t8 that is ΔTd later than the point in time t7. Meanwhile, the air-conditioning control unit (19) outputs the signal (X) to the input section (79) of the camera (70) at the point in time t7. Thus, at the point in time t7 immediately before the operation of the drain pump (66), the camera (70) captures an image.

At the point in time t7 of imaging according to another third control example, the drain pump (66) is at rest. Thus, just like the foregoing embodiment, the total power consumed by the air-conditioning device (10) is low. This allows sufficient power to be reliably supplied to the camera (70) from the power source (18). Further, the surface of the condensed water in the drain pan (60) is also stabilized.

The condensed water is accumulated inside the drain pan (60) until before the start of the operation of the drain pump (66). Thus, the camera (70) capturing an image at the point in time t7 allows the state of the condensed water inside the drain pan (60) to be easily determined.

Second Embodiment

An air-conditioning device (10) according to a second embodiment of the present invention has a basic configuration different from that according to the first embodiment. The air-conditioning device (10) according to the second embodiment takes in outdoor air (OA), and adjusts the temperature and humidity of air. The air-conditioning device (10) supplies the air thus treated as supply air (SA) into the room. That is to say, the air-conditioning device (10) is an outside air treatment system. The air-conditioning device (10) includes a humidifying element (45) for humidifying air, for example, in the winter season.

The air-conditioning device (10) is installed in a space in the ceiling cavity. Just like the first embodiment, the air-conditioning device (10) includes an outdoor unit (not shown) and an indoor unit (11), which are connected together through refrigerant pipes to form a refrigerant circuit.

<Indoor Unit>

Figure 11:
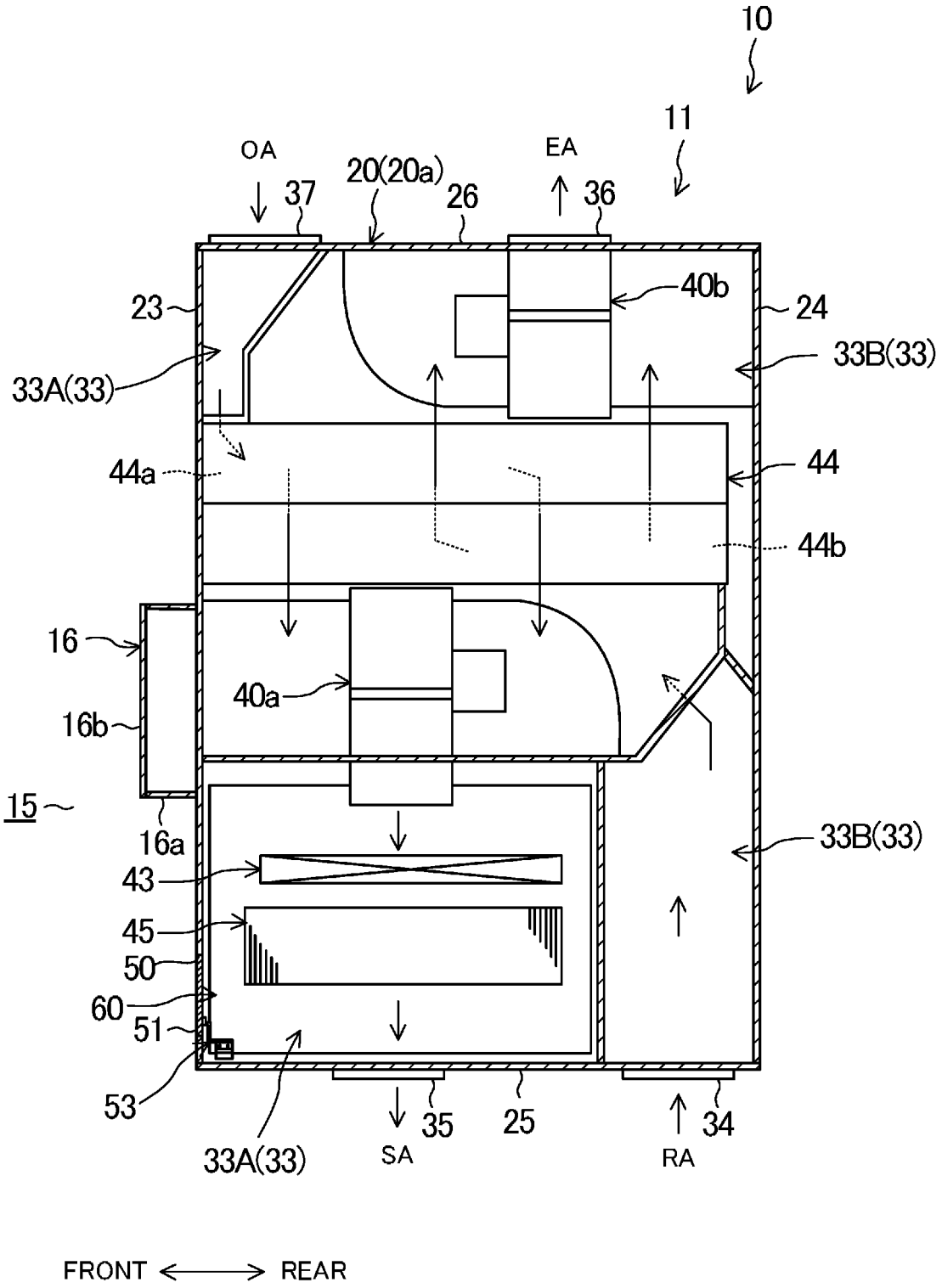
FIG. 11 is a plan view illustrating an internal structure of an air-conditioning device according to a second embodiment.
Figure 12:
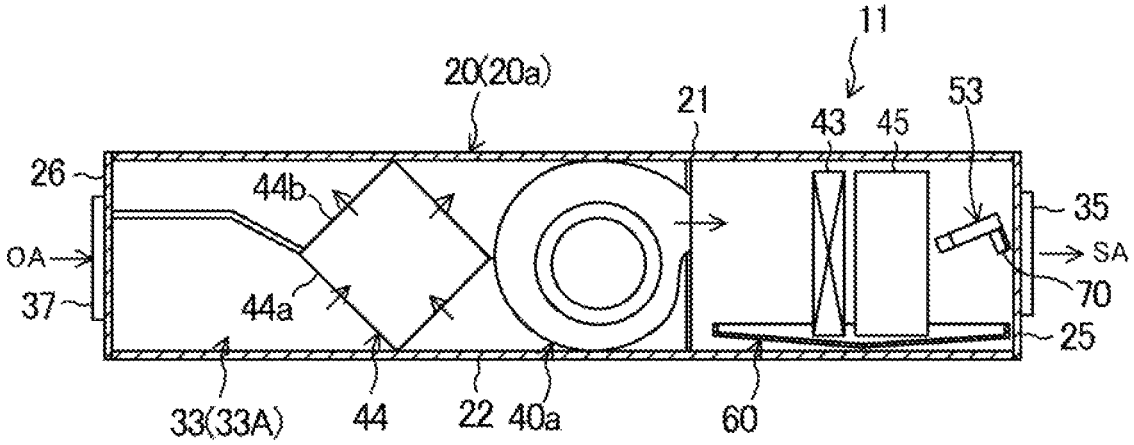
FIG. 12 is a longitudinal sectional view illustrating the internal structure of the air-conditioning device according to the second embodiment.

As illustrated in FIGS. 11 and 12, the indoor unit (11) includes a casing (20) installed in the ceiling cavity, an air supply fan (40*a*), an exhaust fan (40*b*), an indoor heat exchanger (43), a total heat exchanger (44), and the humidifying element (45). The casing (20) includes therein a drain pan (60) collecting condensed water generated in the indoor heat exchanger (43), and an overflow (not shown) for discharging water accumulated in the drain pan (60).

<Casing>

The casing (20) has the shape of a rectangular parallelepiped hollow box. Just like the first embodiment, the casing (20) of the second embodiment includes a top plate (21), a bottom plate (22), a front panel (23), a rear panel (24), a first side panel (25), and a second side panel (26).

The front panel (23) faces a maintenance space (15). The front panel (23) is provided with an electric component box (16), an inspection hole (50), and an inspection cover (51) (which will be described in detail below). The first side panel (25) has an inside air port (34) and an air supply port (35). The inside air port (34) is connected to an inside air duct (not shown). The inlet end of the inside air duct communicates with the indoor space. The air supply port (35) is connected to an air supply duct (not shown). The blow-out port end of the air supply duct communicates with the indoor space. The second side panel (26) has an exhaust port (36) and an outside air port (37). The exhaust port (36) is connected to an exhaust duct (not shown). The blow-out port end of the exhaust duct communicates with the outdoor space. The outside air port (37) is connected to an outside air duct (not shown). The inlet end of the outside air duct communicates with the outdoor space.

The casing (20) has therein an air supply path (33A) and an exhaust path (33B). The air supply path (33A) extends from the outside air port (37) to the air supply port (35). The exhaust path (33B) extends from the inside air port (34) to the exhaust port (36).

<Total Heat Exchanger>

The total heat exchanger (44) has a horizontally long prism shape. The total heat exchanger (44) includes, for example, two types of sheets alternately stacked in the horizontal direction. The sheets of one of the two types form a first passage (44*a*) communicating with the air supply path (33A). The sheets of the other type form a second passage (44*b*) communicating with the exhaust path (33B). Each sheet is made of a material having heat transfer and hygroscopic properties. Thus, the total heat exchanger (44) exchanges latent heat and sensible heat between the air flowing through the first passage (44*a*) and the air flowing through the second passage (44*b*).

<Air Supply Fan>

The air supply fan (40*a*) is disposed in the air supply path (33A) to transfer the air in the air supply path (33A). More specifically, the air supply fan (40*a*) is disposed in a portion of the air supply path (33A) between the first passage (44*a*) of the total heat exchanger (44) and the indoor heat exchanger (43).

<Exhaust Fan>

The exhaust fan (40*b*) is disposed in the exhaust path (33B) to transfer the air in the exhaust path (33B). More specifically, the exhaust fan (40*b*) is disposed in a portion of the exhaust path (33B) downstream of the second passage (44*b*) of the total heat exchanger (44).

<Indoor Heat Exchanger>

The indoor heat exchanger (43) is disposed in a portion of the air supply path (33A) near the front panel (23). The indoor heat exchanger (43) is configured as, for example, a fin-and-tube heat exchanger.

<Humidifying Element>

The humidifying element (45) is disposed in a portion of the air supply path (33A) near the front panel (23). The humidifying element (45) is disposed in a portion of the air supply path (33A) downstream of the indoor heat exchanger (43). The humidifying element (45) includes a plurality of hygroscopic materials, which extend vertically, and are horizontally arranged. Water from a water supply tank (not shown) is supplied to these hygroscopic materials. The humidifying element (45) gives evaporated air to the air flowing around the hygroscopic materials. The air flowing through the air supply path (33A) is humidified in this manner.

<Drain Pan>

As schematically illustrated in FIG. 12, the drain pan (60) is installed below the indoor heat exchanger (43) to collect the condensed water generated in the indoor heat exchanger (43). The drain pan (60) according to the second embodiment is disposed below the humidifying element (45). This allows the drain pan (60) to collect water (humidifying water) flowing out of the humidifying element (45).

<Electric Component Box>

Figure 13:
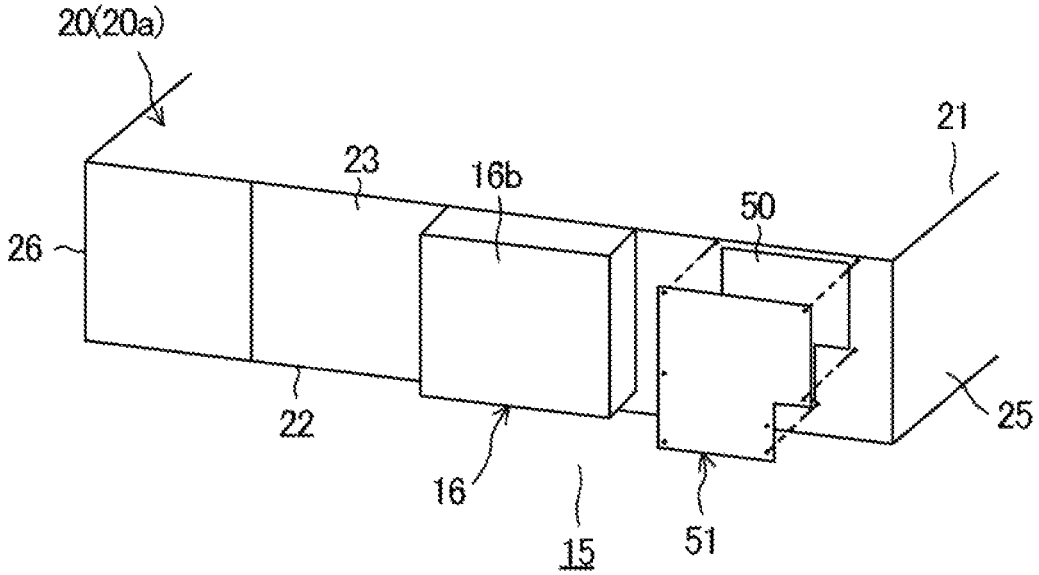
FIG. 13 is a perspective view illustrating a schematic configuration of a portion of the air-conditioning device near a front panel according to the second embodiment.

As illustrated in FIGS. 11 and 13, the electric component box (16) is provided on a substantially central portion of a front surface of the front panel (23). The electric component box (16) houses therein electric components similar to those in the first embodiment.

<Inspection Hole and Inspection Cover>

As illustrated in FIG. 13, the inspection hole (50) is formed in a portion of the front panel (23) near the indoor heat exchanger (43) and the humidifying element (45). The inspection hole (50) is formed at a position corresponding to the drain pan (60) and the humidifying element (45). When the inspection cover (51) is detached from the inspection hole (50), the inside of the drain pan (60) and the humidifying element (45) can be inspected from the maintenance space (15).

The inspection cover (51) is attached to the casing body (20*a*) through a plurality of fastening members. That is to say, just like the second embodiment, the inspection cover (51) is detachably attached to the casing body (20*a*) to open and close the inspection hole (50).

<Stay and Camera>

Figure 14:
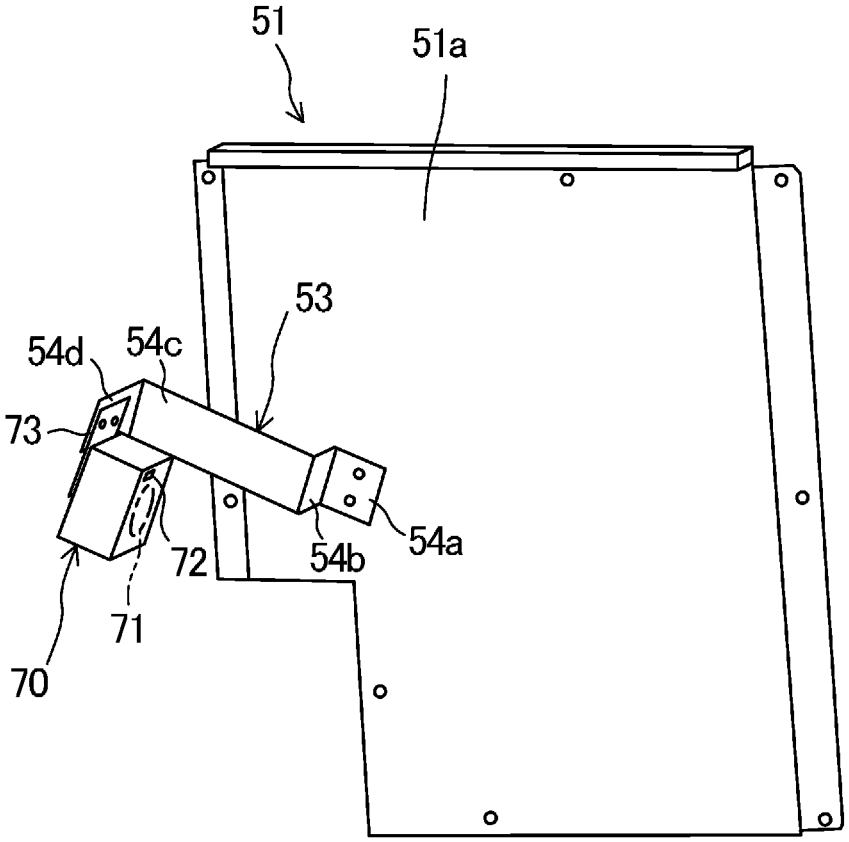
FIG. 14 is a perspective view illustrating an internal structure of an inspection cover according to the second embodiment.

As illustrated in FIG. 14, an inner wall (51*a*) of the inspection cover (51) is provided with a stay (53) for supporting a camera (70) on the inspection cover (51). The stay (53) is fixed to a substantially central portion of the inner wall (51*a*) of the inspection cover (51), and extends in the horizontal direction. A base portion of the stay (53) may be welded to, for example, the inspection cover (51), or may be fastened to the inspection cover (51) via a plurality of bolts (fastening members).

The stay (53) of the second embodiment is a sheet metal folded in a stepwise manner. The stay (53) includes a fixing plate portion (54*a*), a perpendicular plate portion (54*b*), a lateral plate portion (54*c*), and a mounting plate portion (54*d*), which are connected together in this order from its base portion toward its distal end. The fixing plate portion (54*a*) is formed along the inner wall (51*a*) of the inspection cover (51), and is fixed to the inner wall (51*a*) through a plurality of (in this example, two) fastening members (55) (bolts or any other tools). The perpendicular plate portion (54*b*) extends from the inner wall (51*a*) of the inspection cover (51) toward the rear panel (24) of the casing (20). The lateral plate portion (54*c*) is parallel to the inner wall (51*a*) of the inspection cover (51), and extends obliquely upward from the base portion of the stay (53). The mounting plate portion (54*d*) extends from the lateral plate portion (54*c*) toward the rear panel (24) of the casing (20). The mounting plate portion (54*d*) faces obliquely downward so as to be directed to a lowest portion of the bottom portion (63) of the drain pan (60).

The camera (70) is detachably attached to the stay (53). A support plate (73) is fixed to the back surface of the camera (70). The support plate (73) is fixed to the mounting plate portion (54*d*) of the stay (53) via bolts (not shown). As a result, the camera (70) is supported by the stay (53) and thus by the inspection cover (51). The basic configuration of the camera (70) is the same as that of the first embodiment.

While the inspection cover (51) is attached to the casing body (20*a*), the lens (71) of the camera (70) is directed to the inside of the drain pan (60). That is to say, the camera (70) is positioned such that the inside of the drain pan (60) can be imaged in the attached state of the inspection cover (51).

In the second embodiment, while the inspection cover (51) is attached to the casing body (20*a*), the camera (70) is positioned so as to be able to image a portion of the humidifying element (45). In other words, in the second embodiment, the drain pan (60) and the humidifying element (45) are objects to be imaged by the camera (70).

Figure 6:
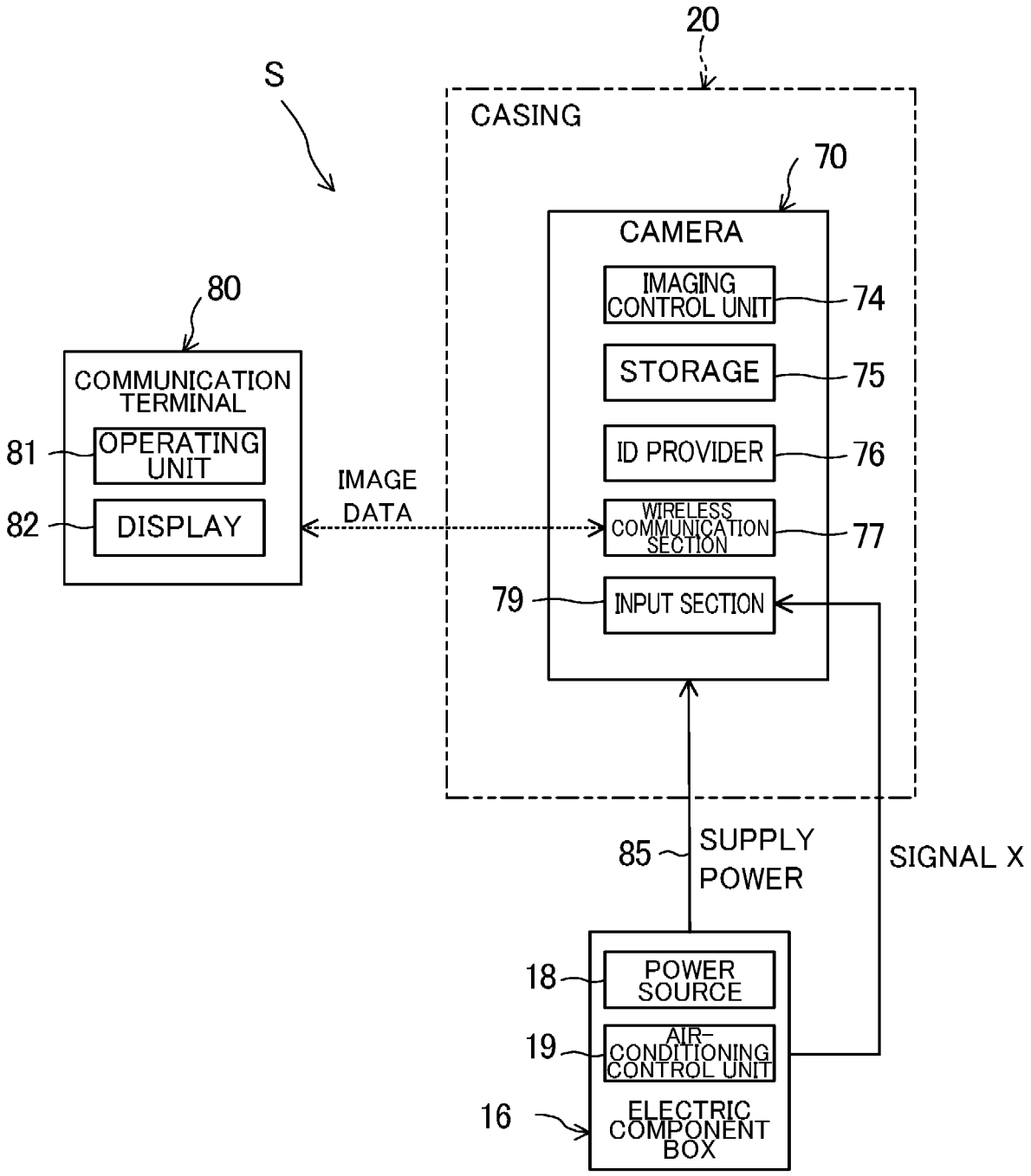
FIG. 6 is a block diagram showing a schematic configuration of an imaging system according to the first embodiment.

The basic configuration of the imaging system (S) is the same as that of the first embodiment (see FIG. 6).

Operation

A basic operation of the air-conditioning device (10) according to the second embodiment will be described with reference to FIGS. 11 and 12. The air-conditioning device (10) is capable of performing a cooling operation and a heating operation.

Just like the first embodiment described above, while the indoor heat exchanger (43) serves as an evaporator in the cooling operation, the indoor heat exchanger (43) serves as a condenser (a radiator) in the heating operation. In the heating operation, the humidifying element (45) operates to humidify air. In the cooling operation and the heating operation, when the air supply fan (40*a*) and the exhaust fan (40*b*) operate, outdoor air (OA) is introduced through the outside air port (37) into the air supply path (33A), and at the same time, room air (RA) is introduced through the inside air port (34) into the exhaust path (33B). Thus, an indoor space is ventilated.

In the cooling operation, the outdoor air (OA) introduced into the air supply path (33A) flows through the first passage (44*a*) of the total heat exchanger (44). Meanwhile, the room air (RA) introduced into the exhaust path (33B) flows through the second passage (44*b*) of the total heat exchanger (44). For example, in the summer season, the outdoor air (OA) has a higher temperature and a higher humidity than the room air (RA). For this reason, latent heat and sensible heat of the outdoor air (OA) are given to the room air (RA) in the total heat exchanger (44). As a result, the air is cooled and dehumidified in the first passage (44*a*). In the second passage (44*b*), the air to which latent heat and sensible heat are given passes through the exhaust port (36), and is discharged as exhaust air (EA) to the outdoor space.

The air cooled and dehumidified in the first passage (44*a*) is cooled in the indoor heat exchanger (43), and then passes through the humidifying element (45) at rest. Thereafter, the air passes through the air supply port (35), and is supplied as supply air (SA) to the indoor space.

In the heating operation, the outdoor air (OA) introduced into the air supply path (33A) flows through the first passage (44*a*) of the total heat exchanger (44). Meanwhile, the room air (RA) introduced into the exhaust path (33B) flows through the second passage (44*b*) of the total heat exchanger (44). For example, in the winter season, the outdoor air (OA) has a lower temperature and a lower humidity than the room air (RA). For this reason, latent heat and sensible heat of the room air (RA) are given to the outdoor air (OA) in the total heat exchanger (44). As a result, the air is heated and humidified in the first passage (44*a*). In the second passage (44*b*), the air from which latent heat and sensible heat are taken passes through the exhaust port (36), and is discharged as exhaust air (EA) to the outdoor space.

The air heated and humidified in the first passage (44*a*) is heated in the indoor heat exchanger (43), and then passes through the humidifying element (45). The humidifying element (45) gives water vaporized through the hygroscopic materials to the air, which is further humidified. The air that has passed through the humidifying element (45) passes through the air supply port (35), and is supplied as supply air (SA) to the indoor space.

<Operation of Imaging System>

In the attached state of the inspection cover (51), the lens (71) of the camera (70) is directed to the drain pan (60) and the humidifying element (45). In this state, when a command for capturing an image is input to the camera (70), the camera (70) captures an image. During imaging, the flash (72) operates so that the inside of the drain pan (60) and the inside of the humidifying element (45) are illuminated. Thus, image data of the inside of the drain pan (60) and the humidifying element (45) are acquired. In the second embodiment, checking the image data of the humidifying element (45) allows, for example, scale and mold formed on the hygroscopic materials of the humidifying element (45) to be recognized.

<Timing of Imaging>

In the cooling operation of the air-conditioning device (10) according to the second embodiment, the camera (70) captures an image at a timing similar to that of each of the first embodiment described above and other control examples. In addition, in the second embodiment, the camera (70) captures an image before the start of the heating operation. Specifically, the camera (70) of the second embodiment captures an image before the start of operations of the fans (the air supply fan (40*a*) and the exhaust fan (40*b*)), before the start of a heating action of the indoor heat exchanger (43), and before the start of an operation of the humidifying element (45).

Figure 15:
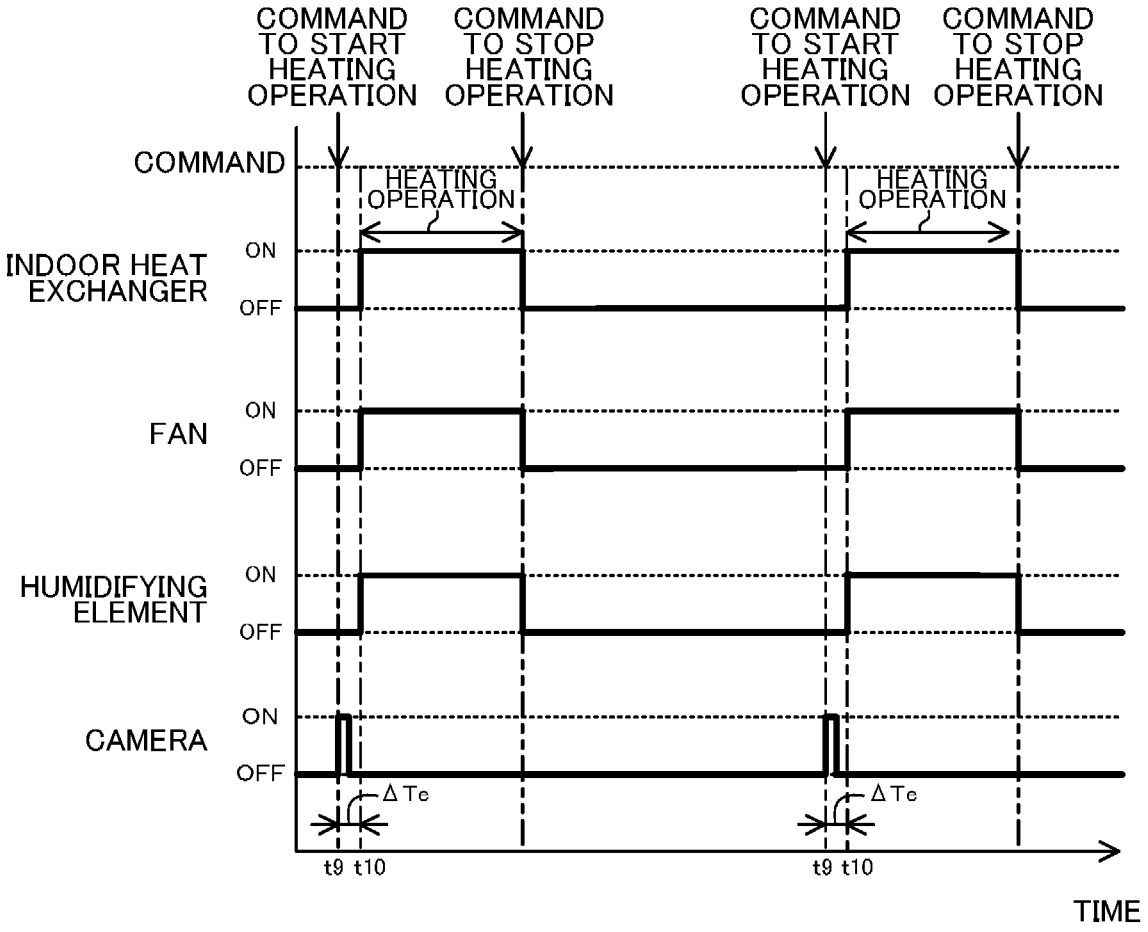
FIG. 15 is a timing chart showing timings of actions of components in a heating operation according to the second embodiment.

As shown in FIG. 15, if an instruction to start the heating operation is input to the air-conditioning control unit (19) at the point in time t9, the air-conditioning control unit (19) performs control for operating the air supply fan (40*a*) and the exhaust fan (40*b*), control for starting the heating action of the indoor heat exchanger (43), and control for operating the humidifying element (45) at the point in time t10 that is ΔTe later than the point in time t9. As a result, the heating operation is started from the point in time t10.

Meanwhile, the air-conditioning control unit (19) outputs the signal (X) for triggering the camera (70) to capture an image to the camera (70) at the same time as the point in time t9 when the instruction to start the heating operation is input. If this signal (X) is input to the input section (79) of the camera (70), the imaging control unit (74) makes the camera (70) capture an image. Thus, the camera (70) acquires image data of the drain pan (60) and the humidifying element (45) at substantially the same timing as the instruction to start the heating operation.

At the point in time t9, the air supply fan (40*a*), the exhaust fan (40*b*), the indoor heat exchanger (43), and the humidifying element (45) are at rest. Thus, at the point in time t9, the total power consumed by the air-conditioning device (10) is low. This allows sufficient power to be reliably supplied to the camera (70) from the power source (18). Further, the surface of water in the drain pan (60) is also stabilized at the point in time t9.

During the period between the previous heating operation and the next heating operation (i.e., the period during which the air-conditioning device (10) is at rest), the formation of scale and mold on the hygroscopic materials of the humidifying element (45) progresses. Thus, immediately before the start of the heating operation, the degree of such scale and mold formed tend to be apparent. In the second embodiment, the humidifying element (45) is imaged at the point in time t9 immediately before the start of the next heating operation. Thus, the formation of scale and mold is apparent from the image data of the humidifying element (45). This allows the degree of dirt on the humidifying element (45) to be more clearly determined.

Variation of Imaging System

The air-conditioning device (10) of each of the first and second embodiments described above may include an imaging system (S) according to a variation described below.

Figure 16:
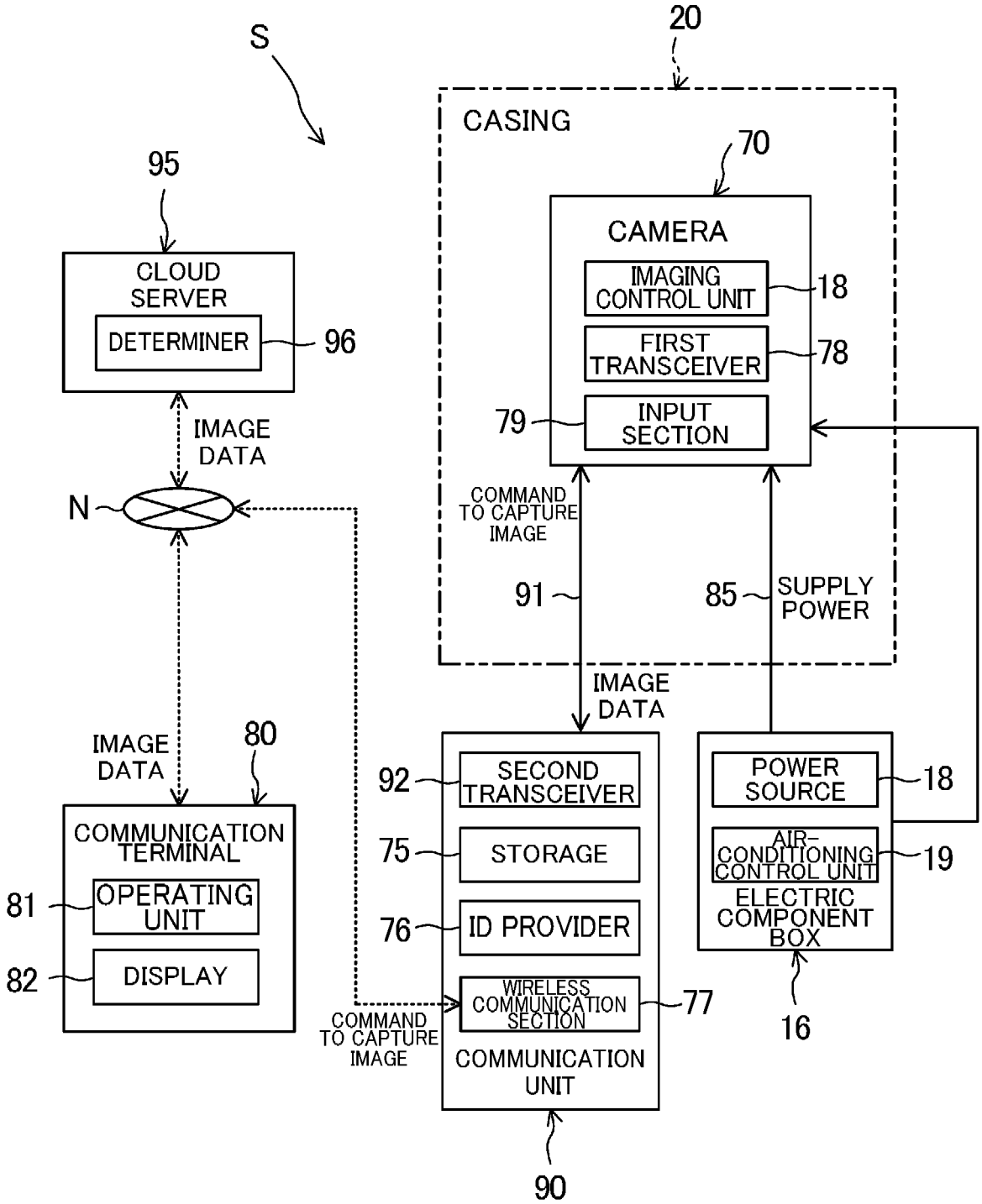
FIG. 16 is a block diagram showing a schematic configuration of an imaging system according to a variation.

The imaging system (S) of the variation shown in FIG. 16 includes a communication unit (90) separate from a camera (70). The communication unit (90) is disposed outside the casing (20), and is connected to the camera (70) via a transmission line (91). The transmission line (91) is inserted into, and run through, a wiring through hole of the inspection cover (51), for example. The transmission line (91) is connected to a first transceiver (78) of the camera (70) and a second transceiver (92) of the communication unit (90). Thus, image data and signals can be exchanged between the camera (70) and the communication unit (90).

In the first and second embodiments, the camera (70) includes the storage (75), the ID provider (76), and the wireless communication section (77). In contrast, in a first variation, the communication unit (90) includes a storage (75), an ID provider (76), and a wireless communication section (77). A communication terminal (80) is wirelessly connected to the wireless communication section (77) of the communication unit (90).

The communication unit (90) and the communication terminal (80) are connected to a cloud server (95) via a network (N).

The image data acquired by the camera (70) are input to the communication unit (90) via the transmission line (91), and is stored in the storage (75) as appropriate. At this time, the ID provider (76) associates ID information corresponding to the image data with the image data. For example, the image data in the communication unit (90) are sent to the cloud server (95) via the network (N), and is stored in the cloud server (95). The communication terminal (80) can acquire the image data from the cloud server (95).

In this variation, the communication unit (90) wirelessly exchanging data with the communication terminal (80) is provided outside the casing (20). Thus, radio waves between the communication terminal (80) and the communication unit (90) are less likely to interfere with each other. As a result, data are stably transmitted.

The cloud server (95) includes a determiner (96). The determiner (96) automatically determines the state of an object (45, 60) to be imaged, based on the image data acquired by the camera (70). The determiner (96) may be included in the communication unit (90), the camera (70), or the communication terminal (80).

If the camera (70) acquires image data on the inside of the object (45, 60) to be imaged in conjunction with the operation of the air-conditioning device (10), the image data are sent to the cloud server (95) via the communication unit (90). The determiner (96) of the cloud server (95) determines the state of the object (45, 60) to be imaged, based on these image data. Here, the determiner (96) is implemented through, for example, use of deep learning as an artificial intelligence (AI) function. Thus, the determiner (96) can determine the degree of dirt on the drain pan (60) and the humidifying element (45), for example. The determiner (96) may determine the degree of dirt on the drain pan (60) and the humidifying element (45) in the future. The determination result of the determiner (96) is transmitted to, for example, the communication terminal (80). Thus, the service provider or any other operator can determine the current or future state of the object (45, 60) to be imaged via the communication terminal (80).

The image data based on which a determination is made by the determiner (96) are acquired at regular intervals in conjunction with the air-conditioning device (10) as described above. This can eliminate causes of error in the image data used for the AI, and can improve the determination accuracy. Acquiring the image data, in particular, in the shown states of the components described above can reliably eliminate the causes of error in the image data arising from the air flow or vibrations.

Other Embodiments

The foregoing embodiments may be modified as follows.

Another part, such as a filter, may be used as an object to be imaged by an imaging device (70).

An image may be captured by the imaging device (70) while another predetermined component, such as a compressor or an outdoor fan, is at rest.

The imaging device (70) should not be limited to a camera, and may be, for example, an optical sensor.

The imaging device (70) is used in a casing (20) of an indoor unit (11) installed in the ceiling cavity, but may be used in a casing of a floor-mounted, wall-mounted, or ceiling-suspended indoor unit, or any other type of indoor unit. Alternatively, the imaging device (70) may also be used in a casing of an outdoor unit.

Various imaging timings shown in the cooling and heating operations described above may be combined in any pattern within a practicable range.

Industrial Applicability

The present invention is useful for an air-conditioning device.

DESCRIPTION OF REFERENCE CHARACTERS

10 Air-conditioning Device
19 Control Unit
20 Casing
40 Fan (Predetermined Component)
40*a* Air Supply Fan (Predetermined Component)
40*b* Exhaust Fan (Predetermined Component)
43 Indoor Heat Exchanger (Predetermined Component)
45 Humidifying Element (Predetermined Component, Object to Be Imaged)
30 Drain Pan (Object to Be Imaged)
30 Camera (Imaging Device)

The invention claimed is:

1. An air-conditioning device comprising:

a casing;

an imaging device that acquires image data of at least one predetermined object to be imaged inside the casing in response to an input signal; and a control unit configured to provide the input signal to the imaging device to capture an image upon input of an instruction to start operation of the air-conditioning device and while the air-conditioning device and/or at least one predetermined component of the air-conditioning device is at rest, wherein when the predetermined component or the air-conditioning device is at rest, the control unit makes the imaging device capture an image when a first signal is input, and after a predetermined time has elapsed since the imaging device captured the image, the control unit operates the predetermined component or the air-conditioning device, the at least one predetermined object to be imaged includes a drain pan that collects condensed water generated inside the casing, the at least one predetermined component includes a fan that transfers air inside the casing, and the control unit controls the fan to operate at a timing when a predetermined time has passed since the input of the first signal to the imaging device.

2. The device of claim 1, wherein the at least one predetermined component includes a heat exchanger that cools air inside the casing, and the control unit provides, the input signal, being the first signal, to the imaging device to capture an image of the drain pan, upon input of an instruction to start a cooling operation of the air-conditioning device, and controls the heat exchanger to start a cooling operation.

3. The device of claim 1, wherein the at least one predetermined object to be imaged and the at least one predetermined component include a humidifying element that humidifies air inside the casing, the control unit provides, the input signal, being the first signal, to the imaging device to capture an image of the humidifying element, upon input of an instruction to start a heating operation, and controls the humidifying element to operate.

4. The device of claim 1, wherein the at least one predetermined component includes a drain pump that drains condensed water inside the drain pan, and the control unit provides, the input signal, being the first signal, to the imaging device to capture an image of the drain pan, upon input of an instruction to start an operation of the drain pump, and controls the drain pump to operate.

5. The device of claim 1, further comprising a power source for the imaging device and for other components of the air-conditioning device alike.

6. The device of claim 1, wherein the at least one object to be imaged includes a humidifying element that humidifies air inside the casing.

7. An air-conditioning device comprising:

a casing;

an imaging device that acquires image data of at least one predetermined object to be imaged inside the casing in response to an input signal; and a control unit configured to provide the input signal to the imaging device to capture an image upon input of an instruction to start operation of the air-conditioning device and while at least one predetermined component of the air-conditioning device is at rest, wherein when a drain pump being the predetermined component is at rest, the control unit makes the imaging device capture an image of a drain pan.

* * * * *